US008579012B2

(12) United States Patent
Godin et al.

(10) Patent No.: US 8,579,012 B2
(45) Date of Patent: Nov. 12, 2013

(54) CONTINUOUS CASTING APPARATUS FOR CASTING STRIP OF VARIABLE WIDTH

(75) Inventors: Daniel Godin, Trois Rivieres (CA); Rejean LeBlanc, Jonquiere (CA)

(73) Assignee: Novelis Inc., Toronto (CA)

( * ) Notice: Subject to any disclaimer, the term of this patent is extended or adjusted under 35 U.S.C. 154(b) by 452 days.

(21) Appl. No.: 12/661,861

(22) Filed: Mar. 24, 2010

(65) Prior Publication Data

US 2010/0243196 A1 Sep. 30, 2010

Related U.S. Application Data

(60) Provisional application No. 61/211,246, filed on Mar. 27, 2009.

(51) Int. Cl.
*B22D 11/06* (2006.01)

(52) U.S. Cl.
USPC ..... 164/463; 164/429

(58) Field of Classification Search
USPC ..... 164/463, 429
See application file for complete search history.

(56) References Cited

U.S. PATENT DOCUMENTS

| | | | | |
|---|---|---|---|---|
| 3,036,348 A | | 5/1962 | Hazelett et al. | |
| 4,061,178 A | | 12/1977 | Sivilotti et al. | |
| 4,727,925 A | | 3/1988 | Asari et al. | |
| 4,869,310 A | * | 9/1989 | Yanagi et al. | 164/431 |
| 5,671,800 A | | 9/1997 | Sulzer et al. | |
| 5,787,968 A | * | 8/1998 | Lauener | 164/481 |
| 6,095,383 A | | 8/2000 | Smith | |
| 6,363,999 B1 | | 4/2002 | Smith | |
| 2008/0115906 A1 | | 5/2008 | Peterson | |

FOREIGN PATENT DOCUMENTS

| | | |
|---|---|---|
| JP | 60-049841 A | 3/1985 |
| JP | 61-0132243 A | 6/1986 |
| JP | 1122638 A | 5/1989 |

OTHER PUBLICATIONS

U.S. Appl. No. 12/661,838, filed Mar. 24, 2010, Godin et al.
U.S. Appl. No. 12/661,862, filed Mar. 24, 2010, Luce et al.
Canadian Intellectual Property Office, International Search Report, Jun. 17, 2010, PCT/CA2010/000462 (Novelis Inc., et al.).
Patent Abstracts of Japan, 01-122638, "Apparatus for Holding Belt in Belt Type Continuous Casting Machine", May 15, 1989, B22D Nov. 2006, Yamane Atsumu, Nishimura Osamu and Shozen Kanji.

* cited by examiner

*Primary Examiner* — Nicholas P D'Aniello
(74) *Attorney, Agent, or Firm* — Kilpatrick Townsend & Stockton LLP

(57) ABSTRACT

Exemplary embodiments of the invention provide a casting apparatus for continuously casting a metal strip article (e.g. a twin-belt metal caster or a twin-block metal caster). The apparatus has a casting cavity defined between a pair of moving elongated opposed casting surfaces, and the casting cavity has an entrance and an exit aligned in a direction of casting. The casting cavity is also provided with a molten metal injector at its entrance, the injector having an internal metal channel including a downstream opening for introducing molten metal into the casting cavity, and a pair of side dams at each lateral side of the casting cavity for confining molten metal from the injector within the cavity. At least one of the side dams comprises an elongated element that is movable laterally relative to the direction of casting during a casting operation. The elongated element extends in the direction of casting from the injector longitudinally between the casting surfaces at least to a downstream position within the casting cavity where the metal adjacent the element is laterally self-supporting.

9 Claims, 6 Drawing Sheets

CONTINUOUS CASTING APPARATUS FOR CASTING STRIP OF VARIABLE WIDTH

CROSS-REFERENCE TO RELATED APPLICATION

This application claims the priority right of prior co-pending provisional application Ser. No. 61/211,246 filed on Mar. 27, 2009 by applicants named herein. The entire contents of application Ser. No. 61/211,246 are specifically incorporated herein by this reference.

BACKGROUND OF THE INVENTION (1) Field of the Invention

This invention relates to the casting of metal strip articles by means of continuous strip casting apparatus of the kind that employs continuously moving elongated casting surfaces and side dams that confine the molten and semi-solid metal to the casting cavity formed between the moving casting surfaces. More particularly, the invention relates to such apparatus in which strip articles of variable width may be produced.

(2) Description of the Related Art

Metal strip articles (such as metal strip, slab and plate), particularly those made of aluminum and aluminum alloys, are commonly produced in continuous strip casting apparatus. In such apparatus, molten metal is introduced between two closely spaced (usually actively cooled) elongated moving casting surfaces forming a narrow casting cavity. The metal is confined within the casting cavity until the metal solidifies (at least sufficiently to form an outer solid shell), and the solidified strip article is continuously ejected from the casting cavity by the moving casting surfaces and may be produced in indefinite length. One form of such apparatus is a twin-belt caster in which two confronting belts are circulated continuously and molten metal is introduced by means of a launder or injector into a thin casting cavity formed between the confronting regions of the belts. An alternative is a rotating block caster in which the casting surfaces are formed by blocks that rotate around a fixed path and join together adjacent the casting cavity to form a continuous surface. The metal is conveyed by the moving belts or blocks for a distance effective to solidify the metal, and then the solidified strip emerges from between the belts at the opposite end of the apparatus.

In order to confine the molten and semi-solid metal within the casting cavity, i.e. to prevent the metal escaping laterally from between the casting surfaces, it is usual to provide metal side dams at each side of the apparatus. For twin-belt and rotating block casters, side dams of this kind can be formed by a series of metal blocks joined together to form a continuous chain aligned in the casting direction at each side of the casting cavity. These blocks, normally referred to as side dam blocks, are trapped between and move along with the casting surfaces and are recirculated so that blocks emerging from the mold exit move around a guided circuit and are fed back into the entrance of the mold. The blocks are guided on this circuit by means of a metal track, or the like, on which the blocks can slide in a loose fashion that allows for limited movement between the blocks, especially as they move around curved parts of the circuit.

When casting strip articles in this way, it is often desirable to produce strip articles of different lateral widths for different purposes. When using the conventional arrangement, this involves terminating the casting operation after the completion of casting of a product of a first width, and re-configuring the caster for the production of a strip article of a second width. For example, it may be necessary to replace one metal injector for a different one of different width, and to move the side dam blocks correspondingly towards or away from the center line of the casting surfaces (which involves moving the entire circuit for recirculating the side dam blocks through the casting cavity and around the external circuit). As this is cumbersome and time-consuming, it would be desirable to provide a system or arrangement for facilitating the change-over of the casting equipment when strip articles of different widths are to be produced.

U.S. Pat. No. 6,363,999 issued to Dennis M. Smith on Apr. 2, 2002 discloses a molten metal injector used with a twin roll caster (in which the metal is cast within the nip formed between the rolls) rather than a twin belt or moving block type caster in which the casting cavity is formed between elongated casting surfaces. The injector is provided with end dams along its sides and these are adjustable towards or away from the center line of the nip. However, the end dams do not extend beyond the nozzle of the molten metal injector.

U.S. pending patent application No. US 2008/0115906, published on May 22, 2008 naming Oren V. Peterson as inventor, describes a metal casting apparatus for steel in which molten metal is poured onto a single moving belt, where it at least partially solidifies, before it is conveyed onto a run-out table on which the solidification process is completed. The apparatus has movable side walls for laterally containing the molten metal and that can be adjusted to produce slabs of different widths. However, there is no upper casting surface and the molten metal is merely poured onto the lower belt rather than being injected from an entrance to a casting cavity.

Other references having side dam arrangements are disclosed, for example, in U.S. Pat. No. 3,063,348 issued on May 29, 1962 to Hazelett et al., U.S. Pat. No. 4,727,925 issued on Mar. 1, 1988 to Asari et al.; Japanese patent application No. JP 60-049841 published on Mar. 19, 1985, and Japanese patent application No. JP 61-0132243 published on Jun. 19, 1986.

There is a need for improved arrangements that can, in particular, make it possible to cast strip articles of different widths without terminating casting operations.

BRIEF SUMMARY OF THE INVENTION

According to one exemplary embodiment, there is provided a metal casting apparatus (e.g. a twin-belt caster or a rotating-block caster) for continuously casting a metal strip article. The apparatus comprises a pair of moving elongated confronting casting surfaces that define a casting cavity between them. The casting cavity has an entrance and an exit aligned in the direction of casting, a molten metal injector at the entrance, the injector having an internal molten metal channel having a downstream opening for introducing molten metal into the casting cavity, and a pair of side dams at each lateral side of the casting cavity for confining molten metal from the injector to the cavity. At least one of the side dams comprises an elongated element that is movable laterally relative to the direction of casting, but is fixed or restrained against movement in the direction of casting, during a casting operation, the elongated element extending in the direction of casting from the injector longitudinally between the casting surfaces at least to a position within the casting cavity where the metal adjacent the element is laterally self-supporting.

The elongated element may be made of a single layer of refractory material that is resistant to attack by molten metal, or may have a composite structure made up, for example, of several layers. The element may also be made of one piece or several pieces articulated together.

Preferably, both of the side dams of the pair comprise an elongated element that is movable laterally relative to the direction of casting during a casting operation, the elongated element extending in the direction of casting from the injector longitudinally between the casting belts at least to a position within the casting cavity where the metal adjacent the element is laterally self-supporting.

The elongated element preferably has a region adjacent to an upstream end thereof that forms one lateral side of the internal channel of the injector, with the elongated element continuing past the opening to the position within the casting cavity. Alternatively, the elongated element has an upstream end that butts against the molten metal injector and thereby partially blocks the opening of the injector.

The apparatus may further comprise an adjustment mechanism contacting the element and adapted to move the element laterally towards or away from a longitudinal centerline of the casting cavity, thereby adjusting a lateral width of the casting cavity. The adjustment mechanism may comprises at least one rigid rod attached to the element at one end thereof and extending laterally between and away from the belts, and a driver adapted to push or pull the rod laterally of the casting direction when required. Preferably, the adjustment mechanism has at least two of the rods separated by a distance, and wherein one or more of the drivers pushes or pulls the rods in unison when desired so that the element remains substantially aligned with the casting direction. Alternatively, each rod may have a driver that pushes or pulls the rods by different amounts so that the element may be tilted relative to the casting direction as it is moved laterally.

Preferably, the molten metal injector comprises an upper refractory wall and a lower refractory wall separated by side walls, and wherein at least one of the side walls comprises a region of the element adjacent an upstream end thereof, the region of the element being movable laterally of the casting direction between the upper and lower refractory walls.

The apparatus makes it possible to adjust the lateral width of a cast strip article without interrupting the casting operation.

Thus, according to another exemplary embodiment, there is provided a method of continuously casting a metal strip article, the method comprising introducing molten metal through an injector having an internal molten metal channel into an entrance of a casting cavity defined between a pair of moving opposed casting surfaces and a pair of side dams at each lateral side of the casting cavity, and withdrawing a cast metal strip article from an exit of the casting cavity, the entrance and exit being aligned in a direction of casting, wherein at least one of the side dams comprises an elongated element that is movable laterally relative to the direction of casting but is restrained against movement in the direction of casting, and, as casting proceeds, moving the at least one of the side dams laterally to vary a width of the casting cavity and thereby a width of the cast strip article leaving withdrawn from the exit.

BRIEF DESCRIPTION OF THE SEVERAL VIEWS OF THE DRAWINGS

Exemplary embodiments of the invention are described in detail in the following with reference to the accompanying drawings, in which.

DETAILED DESCRIPTION OF THE EXEMPLARY EMBODIMENTS

The exemplary embodiments of this invention described in the following are directed in particular for use with twin belt casters, e.g. of the kind disclosed in U.S. Pat. No. 4,061,178 issued to Sivilotti et al. on Dec. 6, 1977 (the disclosure of which patent is incorporated herein by reference). However, other exemplary embodiments may be used with casters of other kinds, e.g. rotating block casters. Twin belt casters have an upper flexible belt and a lower flexible belt that rotate about rollers or stationary guides. The belts confront each other for part of their length to form a thin elongated casting cavity or mold having an entrance and an exit. Molten metal is fed into the entrance and a cast metal slab emerges from the exit. Cooling water sprays are directed onto the interior surfaces of the belts in the region of the casting cavity for the purpose of cooling the casting belts and thereby the molten metal. The molten metal may be introduced into the casting cavity by means of a launder, but it is more usual to provide an injector that projects partially into the casting cavity between the belts at the entrance. Exemplary embodiments may be used most preferably with a type of metal injector having a flexible nozzle as disclosed in U.S. Pat. No. 5,671,800 issued to Sulzer et al. on Sep. 30, 1997 (the disclosure of which patent is incorporated herein by reference).

Figure 1:
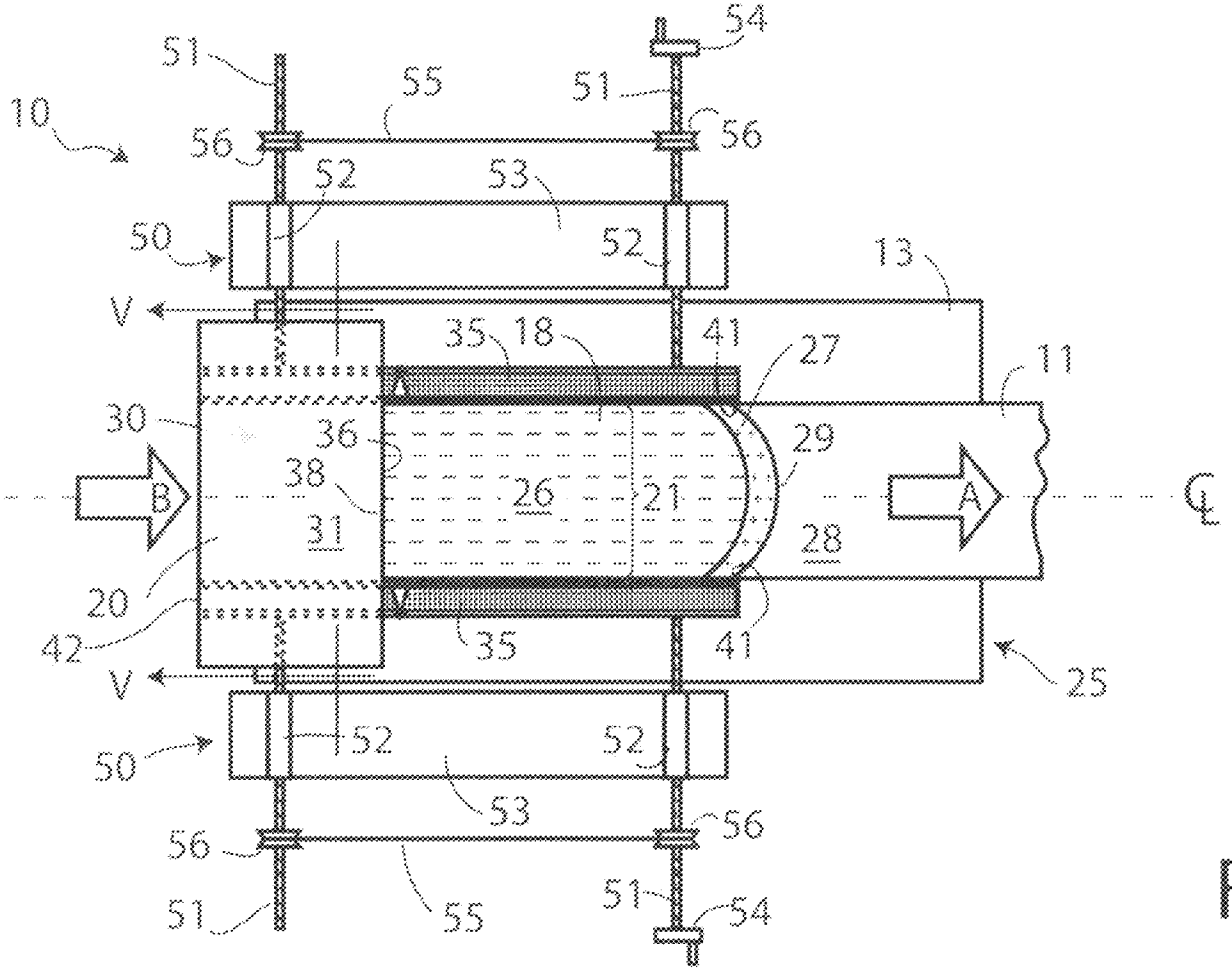
FIG. 1 is a top plan view of a twin-belt casting apparatus according to an exemplary embodiment with the top belt removed to show movable side dams.
Figure 2:
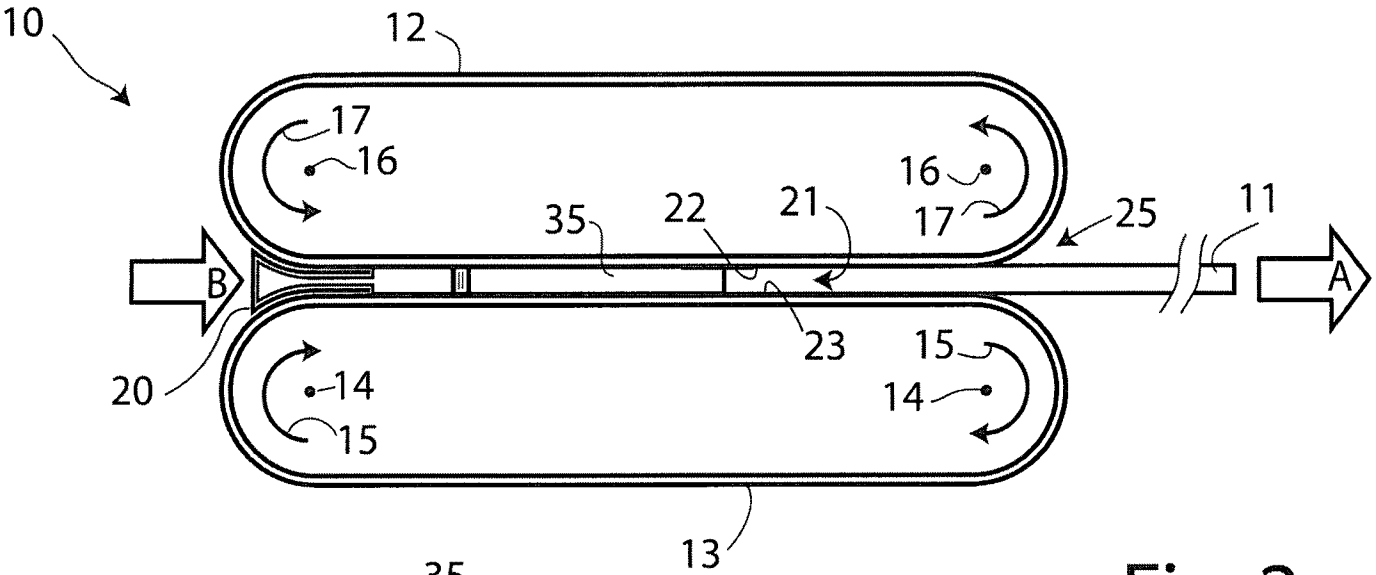
FIG. 2 is a simplified schematic side view of a twin belt casting apparatus showing a side dam of the kind illustrated in FIG. 1.

FIG. 1 of the accompanying drawings is a top plan view of a twin belt casting apparatus 10 with a top belt removed and with lower belt 13 in place illustrating a casting operation in progress producing a strip article 11 (often referred to as a cast slab) advancing in casting direction A. FIG. 2 is a simplified schematic side view of the same apparatus with both rotating casting belts 12 and 13 shown in place. The lower belt 13 (the one visible in FIG. 1) rotates around axes 14 in the direction of arrows 15. Upper belt 12 rotates around axes 16 in the direction of arrows 17. Molten metal 18 (e.g. an aluminum alloy) is introduced into the apparatus at an upstream entrance as represented by arrow B and it passes through a molten metal injector 20 into a casting cavity 21 defined between opposing elongated surfaces 22 and 23 (see FIG. 2) of the upper belt 12 and the lower belt 13. The rear surfaces of the belts within the region of the casting cavity 21 are normally cooled by the application of a liquid coolant (not shown), such as water. The molten metal conveyed by the rotating belts solidifies in the casting cavity downstream of the injector 20 to form the strip article 11 of indefinite length that emerges from the apparatus at an exit 25 of the casting apparatus where the belts 12, 13 move apart in opposite directions. In the case of most metals (particularly aluminum alloys), the metal becomes semi-solid before transforming from the fully molten to the fully solid states. Consequently, the metal in the casting cavity has a molten region 26, a semi-solid region 27 and a fully solid region 28 as it proceeds from injector 20 to exit 25. The semi-solid region 27 is somewhat curved as shown because heat tends to be extracted more slowly from the center of the cast slab than from the sides. Line 29 between the semi-solid region 27 and the fully solid region 28 is often referred to as the solidus line.

Figure 5:
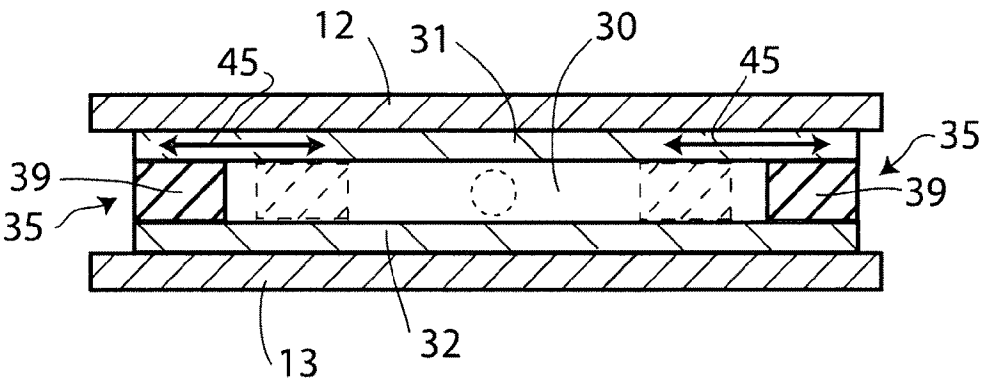
FIG. 5 is an enlarged transverse vertical cross-section of an injector and side dams taken on the line V-V shown in FIG. 1.

The injector 20 has a metal-conveying channel 30 formed between upper and lower injector walls 31, 32 (see, in particular, FIG. 5). The lateral sides of the channel 30 are defined by upstream regions of a pair of mutually spaced laterally movable side dams 35 described more fully later. The molten metal 18 emerges into the casting cavity 21 between the belts 12, 13 through an end opening 36 (see FIG. 1) in a nozzle 38 (i.e. a downstream end region of the injector), and the molten metal is laterally confined within the casting cavity 21 between the pair of side dams 35 until it is fully solid and self-supporting.

Figure 3:
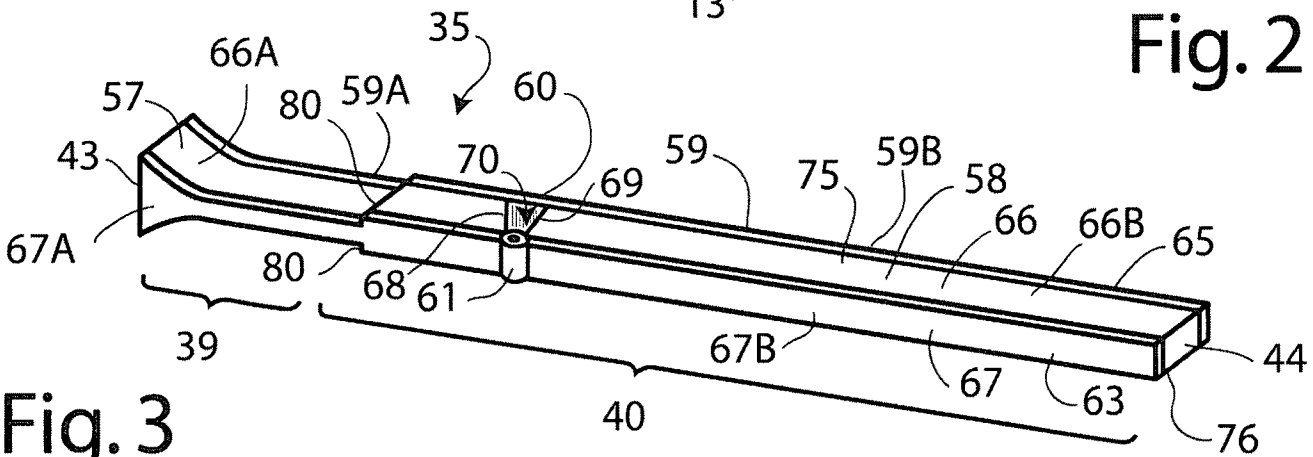
FIG. 3 is a perspective view of a side dam according to an exemplary embodiment shown in isolation.
Figure 4:
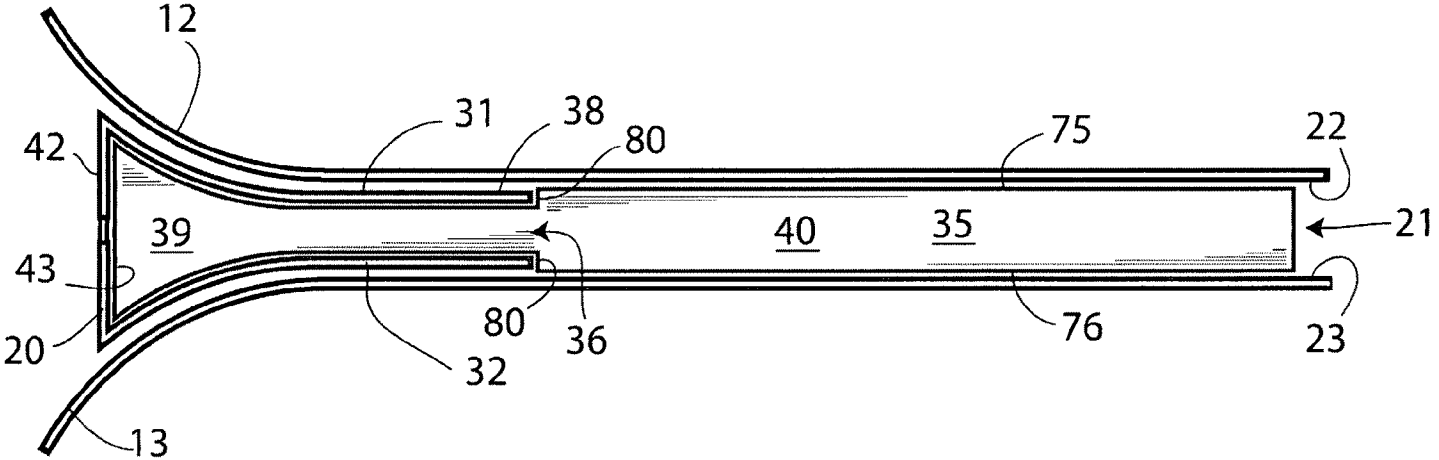
FIG. 4 is a vertical longitudinal cross-section of the side dam of FIG. 3 shown in place between casting belts, but with molten casting metal omitted for clarity.

One of the side dams 35 is shown in isolation in FIG. 3 (the one on the right in FIG. 1 considered in the casting direction A) and in combination with the injector 20 in the enlarged partial side elevation of FIG. 4. As shown in FIG. 3, the side dam 35 has an upstream region 39 and a downstream region 40. The upstream region 39 extends into and forms a lateral side wall of the injector 20 and partially defines the metal-conveying channel 30 within the injector. The downstream region 40 projects from and beyond the opening 36 of the injector 20 and extends along the side of the casting cavity 21 in the casting direction A and forms a side wall of the casting cavity 21 to confine the molten metal 18 contained therein. The side dam 35 extends in the casting direction A preferably only to a point where metal containment is no longer needed (usually a point 41—see FIG. 1—at which the solidus line 29 extends to the side of the casting cavity).

It will be appreciated that, unlike a conventional side dam made of a row of moving blocks, the side dam 35 does not move with the casting belts in the casting direction because its upstream region 39 forms an integral part of the injector 20 which is itself fixed in place (e.g. by having a rear wall 42 fixed to a non-moving part or frame of the apparatus). As can be seen best in FIG. 4, the injector 20 is generally wedge shaped in side view (inwardly tapering in the casting direction) so that it corresponds approximately in shape to the decreasing gap between the belts 12 and 13 at the entrance to the casting cavity. The upstream region 39 of the side dam 35, which forms a side wall of the injector 20, is itself correspondingly wedge-shaped adjacent to its upstream end 43, so it is held against movement in the casting direction (i.e. against being dragged by the casting belts) by virtue of the engagement of the sides of the wedge-shape with the adjacent parts of the upper and lower walls 31 and 32 of the injector 20. The walls 31 and 32 are themselves normally firmly attached to the rear wall 42 of the injector.

While the side dam 35 is restrained from movement in the casting direction, it is free to move horizontally in a sideways direction transverse to the casting direction A. This is illustrated in FIG. 5 which is a vertical cross-section of the injector 20 showing upper and lower walls 31 and 32, casting belts 12, 13 and the upstream regions 39 of two lateral side dams 35 forming part of the injector. As represented by the double-headed arrows 45, the side dams may be moved laterally to reduce or enlarge the width of the metal conveying channel 30 within the injector. If desired, the extreme lateral edges of the upper and lower walls 31, 32 may be provided with supports (e.g. a thin conjoining side wall or struts—not shown) to stabilize these walls against sagging when the side dams 35 are moved inwardly.

Figure 6:
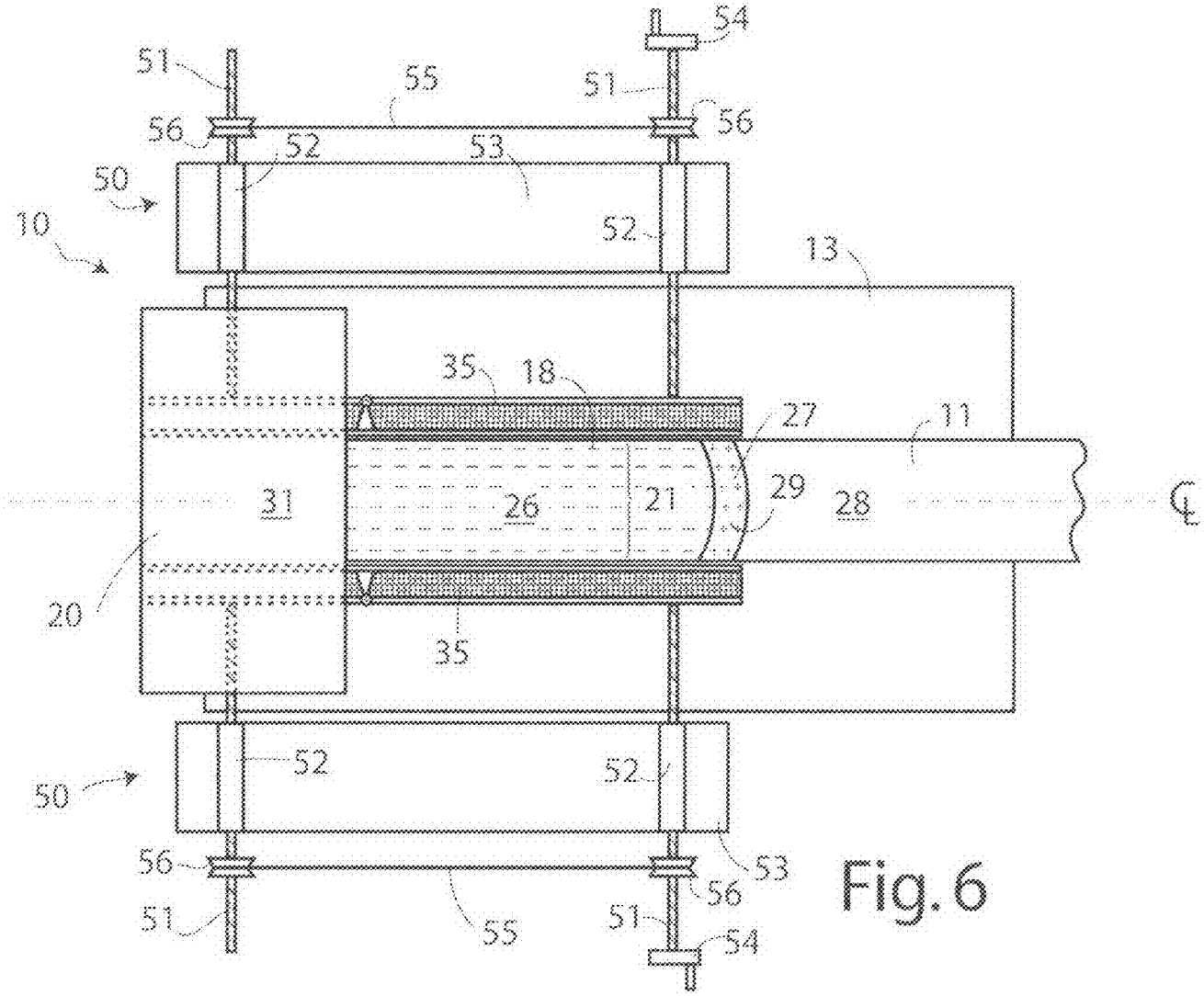
FIG. 6 is a top plan view similar to FIG. 1, but showing the side dams moved laterally inwardly to cast a narrower strip article than in FIG. 1.

As shown in FIG. 6, movement of the side dams 35 inwardly towards the center-line $C_L$ of the belts from the positions shown in FIG. 1 reduces the transverse width of the entire casting cavity 21, thereby causing the width of the strip article 11 to be reduced. Conversely, movement in the outward direction makes it possible to increase the width of the strip article. Adjustments of this kind may be made without interrupting the casting operation, so the width of the strip article can be varied as casting takes place. Of course, the adjustments should preferably be carried out fairly slowly so that metal is not allowed to leak from the casting cavity (when the width is enlarged) and so that the side dams are not pressed excessively forcefully against the fully solid region 28 of the strip article (when the width is reduced). Mechanisms 50 are provided for moving the side dams 35 are shown in FIG. 1 and FIG. 6. The mechanisms comprise externally-threaded rods 51 that pass through internally-threaded sleeves 52 supported by fixed side benches 53 arranged along each side of the casting apparatus. The side dams 35 are held by the rods 51 (e.g., although not shown, by suitable brackets fixed to the side dams that trap an end enlargement of the rod ends while permitting their rotation). Rotation of the rods via adjustment wheels 54 causes the side dams to move closer to the center line $C_L$ of the casting cavity or further away from it. On each side of the casting apparatus, the rods 51 of each pair are normally moved in unison so that there is no tilting or rotation of the side dams 35 relative to the center line as the lateral movement is carried out. Movement in unison in this way may be assured, for example, by providing a flexible belt 55 passing around pulleys 56 attached to the rods. Movement of one rod 51 by rotation of an adjustment wheel 54 causes a corresponding amount of rotation of the second rod of the pair. Of course, more than two such rods ganged together in this way may be provided on each side of the apparatus, if desired.

Lateral adjustment of the side dams allows the width of the strip article to be adjusted from that shown in FIG. 1 (greater width) to that shown in FIG. 6 (lesser width), and vice versa, or to any width in between. As noted, this can be carried out so-called "on-the-fly", i.e. without interruption of the metal flow through the injector and the casting cavity.

In the embodiments of FIGS. 1 to 6 (and best seen in FIG. 3), each side dam 35 preferably comprises two mutually articulated parts, i.e. an upstream part 57 and a downstream part 58, although these parts are not completely separate and a metal contacting surface 59 on an inner side of each side dam extends without interruption from the upstream end 43 to a downstream end 44 so that molten metal cannot escape from the casting cavity at junction 60 positioned between the two parts 57, 58. The upstream and downstream parts of the side dams are connected together by a vertical hinge 61 that allows mutual lateral movement (rotation or pivoting) of the two parts, when desired. The hinge 61 may be positioned at any point between the nozzle 38 and the end of the molten region 26 at the side of the strip article, but is normally positioned part way, as shown in FIGS. 1, 2, 3 and 6, and more preferably about mid-way.

Although it has previously been explained that the mechanisms 50 for moving the side dams avoid tilting of the dams relative to the casting direction in one form of operation of the apparatus, it is sometimes desirable to cause the downstream parts 58 to tilt or pivot relative to the upstream parts 57, for example by adjusting the downstream parts out of coplanar alignment with the upstream parts to allow the casting cavity 21 to diverge slightly laterally (or alternatively to converge slightly laterally) in the casting direction. The angle of divergence (or convergence) can be made constant so that it does not vary as the width of the casting cavity is changed, or it can be made variable so that it changes as the width of the casting cavity is adjusted. If the former is desired (i.e. the angle is to remain constant), then the rods 51 of the pair on each side of the apparatus can be made to have a different length in the section extending from sleeve 52 to side dam 35 to cause the downstream parts 58 to pivot relative to the upstream parts 57 by a predetermined angle, and the belt 55 and pulleys 56 then ensure that the predetermined angle is maintained as the side dams are moved towards or away from the center line $C_L$. If the latter is desired (i.e. angle is to change as the side dams are moved laterally), then the belt 55 may be removed and the two rods 51 of each pair may be adjusted slightly differently to cause the side dams to move laterally, but to a lesser or greater extent for the downstream part 58 relative to the upstream part 57.

It is normally found that a slight outward flare (divergence) of the casting cavity reduces drag on the side dams from the solidifying strip article, particularly around the semi-solid region 27. In general, the working range of movement of the downstream part 58 of the side dam relative to the center line $C_L$ is 10° or less (i.e. 5° on each side of the casting direction). In practice, a range of up to 2-3° on each side of the casting direction is usual which, for a side dam of normal length, may mean a movement at the end of approximately up to 2-5 mm to each side of the casting direction. For example, for a side dam having a moving downstream part 58 of 0.5 m in length, a rotation of 3 mm at the downstream end corresponds to an angle (from the straight line casting direction) of 0.34°, and for a moving downstream part 0.25 m in length, 3 mm of motion corresponds to an angle of 0.5°.

The pivotal arrangement of the two parts 57, 58 of each side dam 35 also makes it possible to accommodate any misalignment between the upstream part 57 and the downstream part 58, for example if a parallel (to the casting direction) or other arrangement is required of the downstream part 58 but is not achieved by the upstream part 57 (e.g. because of a desired internal tapering of the molten metal channel 30 within the injector 20 causing a non-parallel arrangement of the upstream part 57).

The manually adjusted mechanisms 50 may be replaced by other kinds of drive mechanisms, including powered mechanisms such as hydraulic or pneumatic cylinders, electrical motors, and the like, and these may be operated manually or under computer numerical control, if desired, to automate the movements of the side dams.

As noted, and referring in particular to FIG. 3, it will be seen that each side dam 35 has a smooth unbroken elongated metal-contacting surface 59 that extends along one lateral side continuously from the upstream end 43 to a downstream end 44 of the side dam. The other lateral side of the side dam has an opposed outer surface 63. The metal-contacting surface 59 is preferably an outer surface of an elongated strip 65 made of flexible preferably low friction refractory material that is able to resist attack by the molten metal and resists the build-up of solidified metal during casting. A preferred material is a flexible graphite composition, e.g. a material sold under the trademark Grafoil® by American Seal and Packing (a division of Steadman & Associates, Inc.) of Orange County, Calif., USA. However, other materials that have non-wetting, non-reacting, low heat transfer, high wear-resistant and low friction properties may be employed, e.g. carbon-carbon composites, refractory board having a coating of boron nitride, and solid boron nitride.

The strip 65 is preferably backed by an elongated block 66 of heat insulating material, e.g. refractory board. This may be the same kind of material from which the injector 20 is made, or a different material, e.g. the material available from Carborundum of Canada Ltd. as product no. 972-H refractory sheet. This is a felt of refractory fibers typically comprising about equal proportions of alumina and silica and usually containing some form of rigidizer, e.g. colloidal silica, such as Nalcoag® 64029.

In contrast to the strip 65, the elongated block 66 is formed in two separate parts, i.e. an upstream part 66A and a downstream part 66B. The metal-contacting surface 59 thus has an upstream region 59A secured to part 66A of the elongated block 66 and a downstream region 59B secured to downstream part 66B of the elongated block 66. The block 66 is itself backed by a rigid backing element 67 made, for example, of steel or other metal, and it too is formed in two parts 67A and 67B joined by a vertical axis hinge 61. The hinge 61 preferably joins the two parts of the rigid backing element 67. The pivoting at the hinge 61 is accommodated by the shape of inner ends 68 and 69 of the parts 66A and 66B of the insulating block 66 which together form a V-shaped opening 70 at the junction, and by the flexible nature of the strip 65 which allows bending of this element in the region of the opening 70. The flexible strip, insulating block and backing element are preferably attached to each other, e.g. by mechanical fasteners (not shown). Such fasteners ideally attach the flexible strip 65 with a certain amount of longitudinal play relative to the adjacent insulating block 66 (either in region 65A or region 65B or both) so that part 58 of the side dam may be pivoted clockwise (FIG. 3) without causing the flexible strip to stretch unduly at the opening 70 (pivoting in this direction cannot be accommodated by flexing of the strip 65 alone, as it can be for pivoting in the opposite anti-clockwise pivoting direction).

Figure 7:
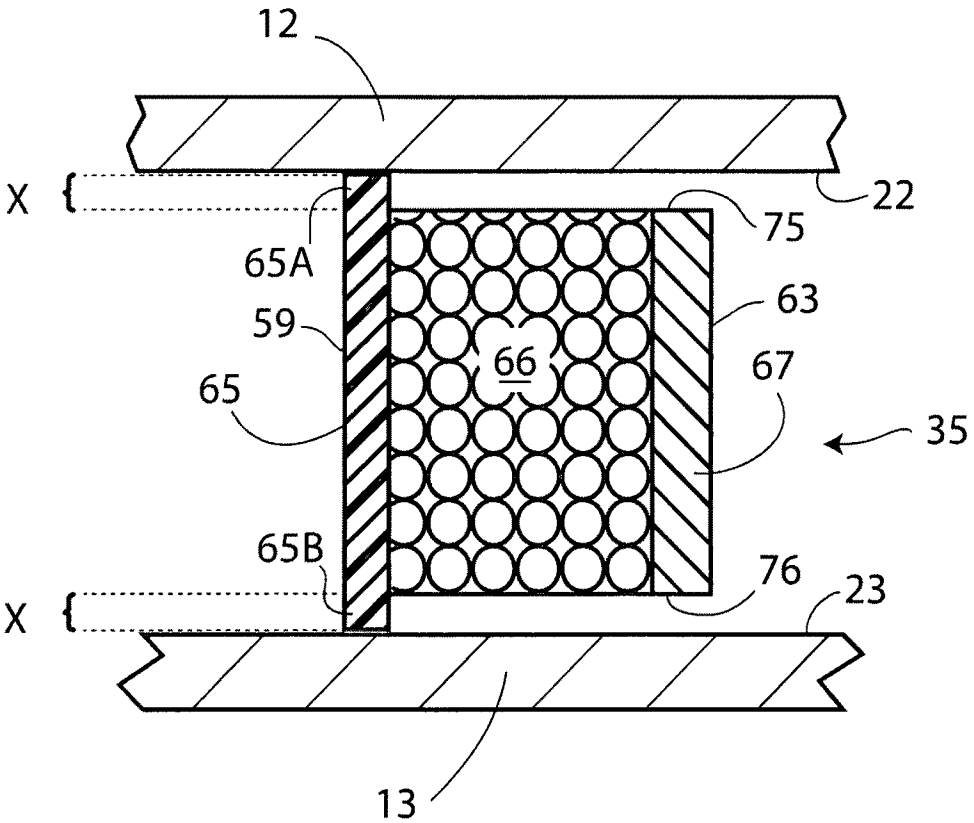
FIG. 7 is a vertical cross-section on an enlarged scale of a side dam of FIG. 4 shown between casting belts.

The low friction property of the flexible elongated strip 65 resists any tendency of the metal to stick or jam against the side dam 35 as the metal solidifies and is advanced by the belts. However, the flexible properties of strip 65 also allow the strip to contact the casting surfaces of the belts in a yielding manner to form a good seal against molten metal outflow with reduced frictional drag from the belts. To facilitate the formation of the seal, the strip may stand proud of the remainder of upper and lower surfaces 75 and 76 of the side dam 35 by a small amount (e.g. up to about 1 mm), at least in the downstream part 58. This is illustrated in FIG. 7 of the drawings, which is a transverse vertical section through the side dam mid-way between its upstream and downstream ends. The flexible strip 65 has upper and lower ends 65A and 65B that stand proud by a distance "X" from the remainder of the upper surface 75 and lower surface 76 of the side dam. In order to further reduce frictional drag from the belts, the remainder of the upper and lower surfaces 75 and 76 of the side dam may be coated with a low friction material (not shown) such as a metal nitride (e.g. boron nitride). Although this sealing effect is desirable, it may not be necessary at least along the entire length of the side dam 35 for reasons given later.

The elongated flexible strip 65 and the insulating block 66 are preferably made of heat insulating material and thus have low thermal mass and low thermal conductivity (much lower than the cast iron or mild steel of conventional side dam blocks) so that very little heat is withdrawn from the metal slab at the sides and the metal tends to cool uniformly across the slab to provide uniform solid microstructure and thickness. Furthermore, the metal tends not to freeze on the elongated flexible layer as little heat is withdrawn through it. Any metal that does freeze directly onto the flexible strip is easily carried away by the remainder of the moving slab because of the low friction properties of the strip. Therefore, solid metal tends not to build up on the stationary side dams.

The rigid backing element 67 serves to protect and support the other elements of the side dam which other parts may be rather delicate and easily damaged. This element also allows the side dam to be anchored firmly in place by rods 51 and serves to contain molten metal in the event of failure of the dam (e.g. by blocking the outflow of molten metal and/or causing it to freeze due to withdrawal of heat).

As noted, the side dams preferably extend in the casting direction to positions just downstream of the points 41 where the metal slab becomes fully solid at the side edges. This facilitates the operation of width adjustment (particularly width reduction) because there is only a small part of each side dam in contact with the fully solid metal part 28 of the strip article that tends to resist width reduction. This length limitation of the side dams also has other advantages. For example, the casting cavity 21 is often made to converge or diverge vertically in the casting direction to facilitate heat removal from the strip article. Therefore, if the side dam 35 is of constant height along its length, its upper and lower surfaces 75, 76 will be positioned closer (or further away from) the casting surfaces 22, 23 adjacent to the injector 20 than adjacent to the downstream end 44 as the cavity diverges (or converges) vertically in the casting direction. By making the side dams 35 as short as possible, greater degrees of convergence of the casting cavity is possible (because the side dams are not present adjacent to the exit 25 where the convergence of the cavity is greatest). In fact, the convergence (or divergence) of the casting cavity is often only about 0.015 to 0.025% (for example, corresponding to the linear shrinkage of the strip article), so there is not a great change in the distance between the casting surfaces, especially over the shortened region occupied by the side dams. Of course, if the degree of vertical convergence or divergence of the casting cavity never varies, the side dams 35 may be made to taper by corresponding amounts so that the upper and lower surfaces 75, 76 remain at the same spacing from the adjacent casting surfaces for the entire lengths of the side dams.

As mentioned above (and shown in FIG. 7), the strip 65 may form a seal with the casting surfaces 22, 23 but, because of the convergence or divergence of the casting cavity, this seal may not be present all along the length of the side dam. In fact, metal will not escape above or below the side dam even if there is a gap between the side dam and the casting surfaces, provided the gap does not exceed about 1 mm. This is because the surface tension of the molten metal causes the metal to bridge gaps of this size without penetration through the gaps. Therefore, if the casting cavity converges in the casting direction, there may be such gaps between the side dams and casting surfaces adjacent the injector 20, and this gap may reduce along the length of the side dam until it disappears altogether as shown in FIG. 7. Further convergence may then be accommodated by the flexible nature of upper and lower ends 65A, 65B of the flexible strip 65, which can be slightly compressed.

The distance along the casting cavity that the side dams 35 are required to extend beyond the injector 20 depends on the length of the region 26 of molten metal and the region 27 of semi-solid metal (i.e., in combination, the length of the so-called molten metal "sump"). This, in turn, depends on the characteristics of the alloy being cast, the casting speed and the thickness of the slab being cast. Table 1 below provides typical working and preferred ranges for common aluminum alloys.

TABLE 1

| | Working Range | Preferred Range | Most Preferred |
|---|---|---|---|
| Slab Thickness (mm) | 5-100 | 8-25 | |
| Casting Speed (m/min) | 0.5-20 | 2-10 | |
| % Protrusion along Cavity | 5-100 | 20-75 | 35-75 |

In the embodiment of FIGS. 1 to 7, the molten metal flows through the injector 20 and the casting cavity without encountering any barriers or projections and hence flows in a smooth laminar manner without developing eddy currents or the like. Since the side dams extend continuously from the metal entrance to a point beyond the termination of molten metal flow, the flow remains laminar even when the width of the strip article is varied as the side dams 35 are moved laterally. It will also be noticed from FIGS. 3 and 4 that each side dam 35 has a step 80 in the upper and lower surfaces 75, 76 at the point where the side dam exits the injector 20. This ensures that the side dams extend completely (or almost completely) between the upper belt 12 and the lower belt 13 within the casting cavity while also having a reduced height necessary to fit between the upper and lower walls 31, 32 in the region 39 that extends into (and forms part of) the injector 20.

Figure 9:
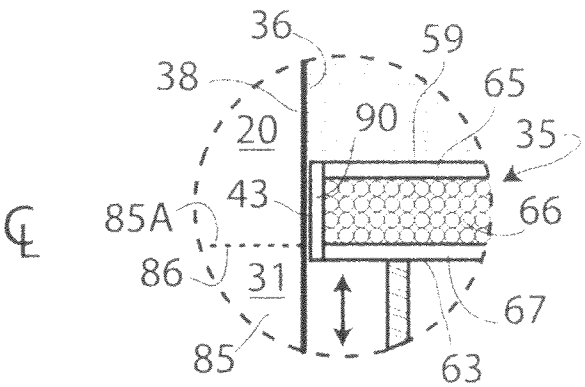
FIG. 9 is an enlarged detail of FIG. 8 showing the region of FIG. 8 encircled by broken circle IX.
Figure 8:
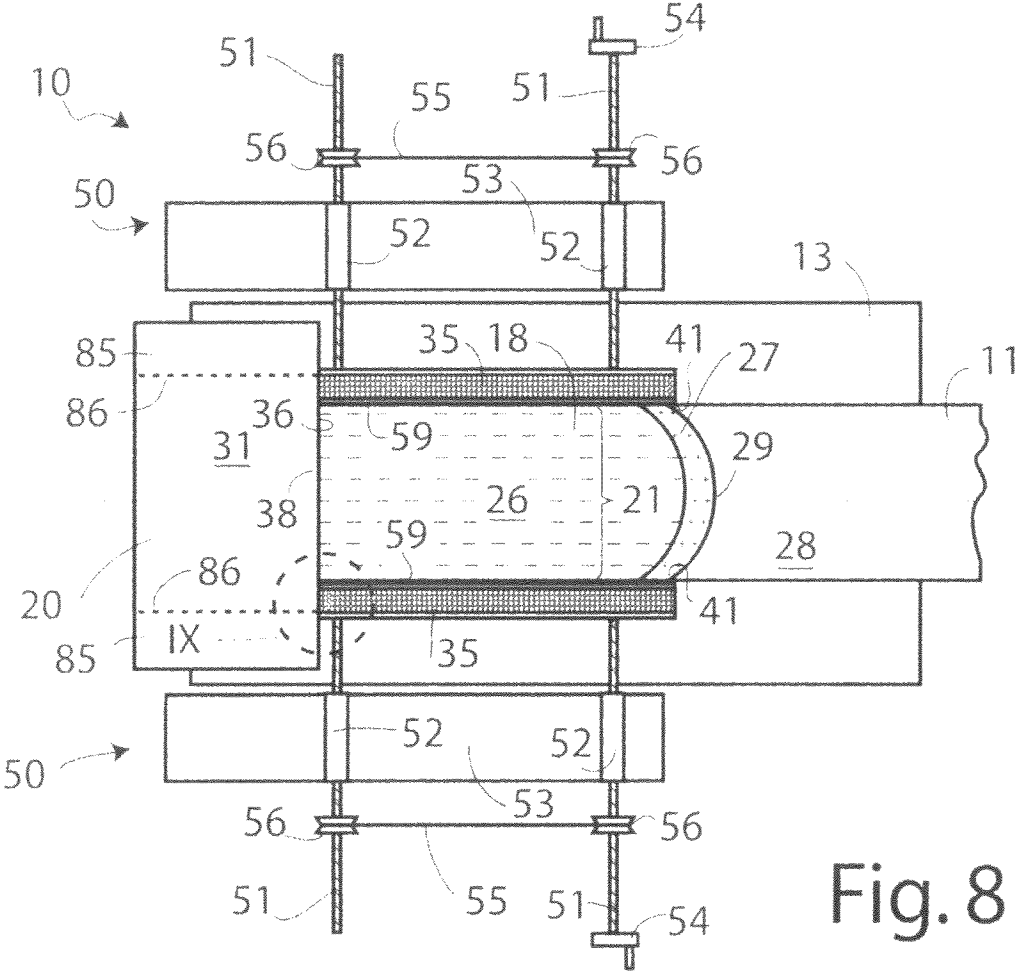
FIG. 8 is a top plan view similar to that of FIG. 1, but showing an alternative exemplary embodiment.

FIGS. 8 and 9 of the accompanying drawings illustrate an alternative exemplary embodiment in which the side dams 35 do not have an upstream region extending into, and forming a sidewall of, the injector 20. Instead, the side dams 35 have only a downstream region commencing at the exit of the injector 20 and extending in the casting direction to a point beyond the point 41 where the solidus line 29 reaches the side of the strip article 11. The injector 20 is provided with fixed side walls 85 between upper and lower walls 31 and 32 as represented by broken lines 86. As in the previous embodiment, the side dams 35 arranged on each side of the apparatus are adjustable laterally so that the horizontal width of the casting cavity 21 can be varied during casting by the same kind of adjusting mechanisms 50. The region where the upstream end 43 of a side dam and the injector 20 meet is shown on an enlarged scale in FIG. 9. Essentially, the upstream end 43 blocks a part of the molten metal opening 36 in the nozzle 38 when it is moved inwardly beyond the inner extent of the side wall 85, thus making the opening 36 conform in width to the width of the downstream casting cavity. Of course, the side dam should not be moved inwardly to such an extreme extent that outer surfaces 63 of the side dams 35 move further inward than the lateral ends of the opening 36 in the nozzle 38, or molten metal will escape around the side dams, but the lateral width of the side dams may be predetermined to avoid such an event over the normal range of adjustment of the casting width. In this embodiment, it is preferable to provide the upstream end 43 of the side dam with a layer 90 of material that helps to seal any gap that may arise between the nozzle and the side dam, thus preventing loss of metal through such a gap. This may be the same material as that used for elongated strip 65.

Since the side dams 35 are not integral with the injector 20 in this embodiment, the side dams must be held against movement by the belts in some other manner, e.g. by attaching the rods 51 firmly to the side dams 35 in a way that prevents movement of the latter in the casting direction.

While FIG. 8 shows the side dams partially blocking the opening 36 of the injector, the side dams may be moved outwardly either to positions where the inner surfaces 59 are perfectly aligned with inner surfaces 85A of the fixed side walls 85 of the injector, or to positions where the width of the casting cavity is made greater than the width of the opening 36. Except when there is perfect alignment, the desired laminar flow of the molten metal may be disturbed to some extent and eddy currents may develop, but not to the extent that the cast product is made unacceptable for most commercial uses.

In all of the exemplary embodiments, while it is preferred to move both of the side dam blocks (i.e. the side dam blocks on each side of the casting cavity) to reduce or enlarge the lateral width of the strip article in the same way on both sides of the center line, only one of the side dam blocks may be moved instead, if desired. Indeed, only one of the side dam blocks may be made movable and the other may be fixed, although this is not a preferred arrangement. It is also possible, though not particularly desired, to employ one fixed side dam as indicated above with a conventional movable side dam (made up of a line of side dam blocks).

What we claim is:

1. A casting apparatus for continuously casting a metal strip article, said apparatus comprising a casting cavity defined between a pair of moving opposed casting surfaces, said casting cavity having an entrance and an exit aligned in a direction of casting, a molten metal injector at said entrance, said injector having an internal molten metal channel including a downstream opening for introducing molten metal into the casting cavity, and a pair of side dams at each lateral side of the casting cavity for confining molten metal from the injector within said cavity, wherein said apparatus comprises a twin-belt metal caster having rotating belts forming said casting surfaces, and at least one of said side dams comprises an elongated element having a molten metal contacting surface that is movable laterally relative to said direction of casting during a casting operation but is restrained against movement in the direction of casting, said elongated element extending in said direction of casting from said injector longitudinally between said casting surfaces at least to a downstream position within the casting cavity where, in use, said metal adjacent said element is laterally self-supporting.

2. The apparatus of claim 1, wherein both of said side dams of said pair comprise an elongated element having a molten metal contacting surface that is movable laterally relative to said direction of casting during a casting operation.

3. The apparatus of claim 1, wherein said elongated element has a region adjacent to an upstream end thereof that forms one lateral side of said internal channel of the injector, with said elongated element continuing beyond said downstream opening of said injector to said downstream position within the casting cavity.

4. The apparatus of claim 1, wherein said elongated element has an upstream end that butts against said molten metal injector and thereby partially blocks said opening of the injector.

5. The apparatus of claim 1, further comprising an adjustment mechanism contacting said element and adapted to move said element laterally towards or away from a longitudinal centerline of said casting cavity, thereby adjusting a lateral width of said casting cavity.

6. The apparatus of claim 5, wherein said adjustment mechanism comprises at least one rigid rod attached to said element at one end thereof and extending laterally outwardly between said casting surfaces, and a driver adapted to push or pull said rod laterally of said casting direction as required.

7. The apparatus of claim 6, wherein said adjustment mechanism has at least two of said rods separated by a distance in said casting direction, and wherein said drivers pushes or pulls said rods in unison as desired so that said element remains substantially aligned with said casting direction.

8. The apparatus of claim 6, wherein said adjustment mechanism has at least two of said rods and each provided with a driver, said drivers being adapted to push or pull said rods by different amounts as desired when moving said element laterally, thereby causing the element to tilt relative to said casting direction.

9. The apparatus of claim 1, wherein said molten metal injector comprises an upper refractory wall and a lower refractory wall separated by side walls, and wherein at least one of said side walls comprises a region of said element adjacent an upstream end thereof, said region of said element being movable laterally of said casting direction between said upper and lower refractory walls.

* * * * *